US008545267B2

(12) United States Patent
Fogg et al.

(10) Patent No.: US 8,545,267 B2
(45) **Date of Patent: *Oct. 1, 2013**

(54) ELECTRICAL CONNECTOR ASSEMBLY

(75) Inventors: Michael Warren Fogg, Harrisburg, PA (US); Steven David Dunwoody, Middletown, PA (US); Richard James Long, Columbia, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/599,516

(22) Filed: Aug. 30, 2012

(65) Prior Publication Data

US 2012/0322308 A1 Dec. 20, 2012

Related U.S. Application Data

(63) Continuation-in-part of application No. 12/896,611, filed on Oct. 1, 2010, now Pat. No. 8,277,252.

(51) Int. Cl.
*H01R 13/648* (2006.01)

(52) U.S. Cl.
USPC ..... 439/607.25

(58) Field of Classification Search
USPC ..... 439/607.25, 607.01, 607.17, 607.18, 439/439/607.21, 939, 108, 541.5, 138, 752, 439/79, 676
See application file for complete search history.

(56) References Cited

U.S. PATENT DOCUMENTS

| | | | | |
|---|---|---|---|---|
| 7,070,446 | B2 | 7/2006 | Henry et al. | |
| 7,249,966 | B2 | 7/2007 | Long | |
| 7,467,972 | B2 * | 12/2008 | Long | 439/541.5 |
| 7,641,515 | B1 | 1/2010 | Szczesny et al. | |
| 7,704,097 | B1 | 4/2010 | Phillips et al. | |
| 7,845,975 | B2 | 12/2010 | Cheng et al. | |
| 8,277,252 | B2 * | 10/2012 | Fogg et al. | 439/607.25 |
| 2010/0111476 | A1 | 5/2010 | Shirk et al. | |
| 2011/0059625 | A1 * | 3/2011 | Westman et al. | 439/55 |
| 2012/0329325 | A1 * | 12/2012 | Fogg et al. | 439/607.25 |

* cited by examiner

*Primary Examiner* — Edwin A. Leon

(57) ABSTRACT

An electrical connector assembly includes a shielding cage member having an upper port and a lower port configured to receive pluggable modules therein with side walls along the sides of the upper and lower ports. A separator member extends between the side walls between the upper and lower ports. The separator member has an upper plate and a lower plate with a channel therebetween. The upper and lower plates have interior surface facing the channel and exterior surfaces facing the upper and lower ports, respectively. RF absorbers are positioned along the exterior surfaces and are exposed along the upper and lower ports. The RF absorbers reduce an amount of EMI propagation through the cage member. A divider wall is positioned in the channel and extends between the interior surfaces of the upper and lower plates.

13 Claims, 8 Drawing Sheets

ELECTRICAL CONNECTOR ASSEMBLY

CROSS REFERENCE TO RELATED APPLICATIONS

This application is a continuation-in-part application of U.S. patent application Ser. No. 12/896,611 filed Oct. 1, 2010, titled ELECTRICAL CONNECTOR ASSEMBLY, the subject matter of which is herein incorporated by reference in its entirety.

BACKGROUND OF THE INVENTION

The subject matter herein relates generally to electronic connector assemblies.

It is known to provide a metal cage with a plurality of ports, whereby transceiver modules are pluggable therein. It is desirable to increase the port density associated with the network connection, such as, for example, switch boxes, cabling patch panels, wiring closets, and computer I/O. Several pluggable module designs and standards have been introduced in which a pluggable module plugs into a receptacle which is electronically connected to a host circuit board. One such standard that has been promulgated and accepted in the industry is referred to as the small form factor pluggable (SFP) standard which specifies an enclosure height of 9.8 mm and a width of 13.5 mm and a minimum of 20 electrical input/output connections. Such pluggable modules or transceivers provide an interface between a computer and a data communication network such as Ethernet, InfiniBand, Fiber Channel or Serial Attach SCSI.

It is also desirable to increase the operating frequency of the network connection. For example, applications are quickly moving to the multi-gigabit realm. Electrical connector systems that are used at increased operating speeds present a number of design problems, particularly in applications in which data transmission rates are high, e.g., in the range above 10 Gbps (Gigabits/second). Of particular concern is reducing electromagnetic interference (EMI) emissions. Due to government regulations, there is a need not only to minimize the EMI emissions of the module, but also to contain the EMI emissions of the host system in which the module is mounted regardless of whether a module is plugged in to the receptacle.

In conventional designs, EMI shielding is achieved by using a shielded metal cage surrounding the receptacles. However, as the speeds of the network connections increase, the EMI shielding provided by conventional cages is proving to be inadequate. Therefore, there is a need for a connector system design that conforms to the SFP standard while minimizing EMI emissions. There is a need to reduce EMI emissions from electrical connectors other than SFP type connectors.

BRIEF DESCRIPTION OF THE INVENTION

In one embodiment, an electrical connector assembly is provided that includes a shielding cage member having an upper port and a lower port configured to receive pluggable modules therein with side walls along the sides of the upper and lower ports. A separator member extends between the side walls between the upper and lower ports. The separator member has an upper plate and a lower plate with a channel therebetween. The upper and lower plates have interior surfaces facing the channel and exterior surfaces facing the upper and lower ports, respectively. RF absorbers are positioned along the exterior surfaces and are exposed along the upper and lower ports. The RF absorbers reduce an amount of EMI propagation through the cage member. A divider wall is positioned in the channel and extends between the interior surfaces of the upper and lower plates.

Optionally, the divider wall may be approximately centrally positioned between the side walls. The divider wall may make ohmic contact to the upper plate and the lower plate. Optionally, the upper and lower plates may extend lengthwise along a longitudinal axis with the divider wall extending a length at least half a length of the separator member. The upper plate may include an upper pocket receiving the corresponding RF absorber such that an outer surface of such RF absorber facing the upper port is substantially coplanar with a portion of the upper plate. The lower plate may include a lower pocket receiving the corresponding RF absorber such that an outer surface of such RF absorber facing the lower port is substantially coplanar with a portion of the lower plate.

Optionally, the divider wall may divide the channel into a first sub-channel between the divider wall and one of the side walls and the divider wall may divides the channel into a second sub-channel between the divider wall and the other of the side walls. The divider wall may include airflow openings therethrough to allow airflow from one side of the divider wall to another side of the divider wall. A first light pipe may extend through the channel along a first side of the divider wall and a second light pipe may extend through the channel along a second side of the divider wall.

Optionally, the RF absorbers may be sheets applied to the exterior surfaces of the upper and lower plates. The RF absorbers may constitute surface wave absorbers arranged generally parallel to a direction of EMI propagation through the cage member. The RF absorbers may be fabricated from elastomeric material.

Optionally, the separator member may be U-shaped with a front wall between the upper plate and the lower plate. The electrical connector assembly may include a receptacle connector in the cage member rearward of the separator member. The receptacle connector may generate an energy field through the channel and the upper and lower ports in the direction of the front wall. The RF absorbers may reduce the energy field propagation through the upper and lower ports. The divider wall may reduce the energy field propagation through the channel.

DETAILED DESCRIPTION OF THE INVENTION

Figure 1:
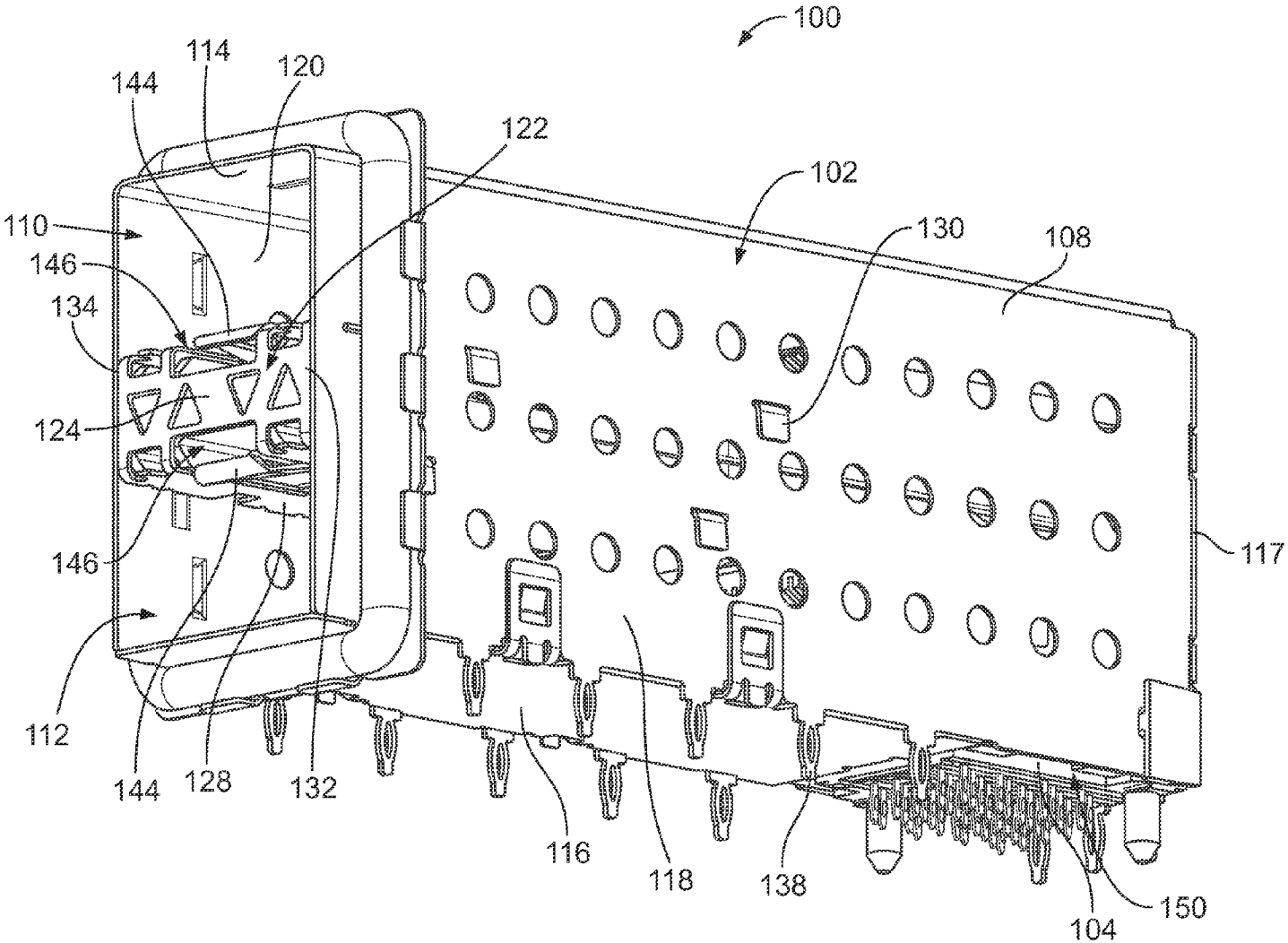
FIG. 1 is a front perspective view of an electrical connector assembly formed in accordance with an exemplary embodiment showing a cage member and a receptacle connector.

FIG. 1 is a front perspective view of an electrical connector assembly 100 formed in accordance with an exemplary embodiment. The electrical connector assembly 100 includes a cage member 102 and a receptacle connector 104 received in the cage member 102. Pluggable modules 106 (shown in FIG. 7) are configured to be loaded into the cage member 102 for mating with the receptacle connector 104. The receptacle connector 104 is intended for placement on a circuit board, such as a motherboard, and is arranged within the cage member 102 for mating engagement with the pluggable modules 106.

The cage member 102 is a shielded, stamped and formed cage member that includes a plurality of shielded walls 108 that define multiple ports 110, 112 for receipt of the pluggable modules 106. The port 110 defines an upper port positioned above the port 112 and may be referred to hereinafter as upper port 110. The port 112 defines a lower port positioned above the port 110 and may be referred to hereinafter as lower port 112. Any number of ports may be provided in alternative embodiments. In the illustrated embodiment, the cage member 102 includes the ports 110, 112 arranged in a single column, however, the cage member 102 may include multiple columns of ports 110, 112 in alternative embodiments.

The cage member 102 includes a top wall 114, a lower wall 116, a rear wall 117 and side walls 118, 120, which together define the general enclosure for the cage member 102. The cage member 102 is subdivided by a center separator member 122 to define the upper and lower ports 110, 112. The separator member 122 extends between the side walls 118, 120. The separator member 122 has a front wall 124 with an upper plate 126 (shown in FIG. 3) and a lower plate 128 extending rearward from the front wall 124. The separator member 122 is retained in place by tabs 130, which extend from side edges 132, 134 of the upper and lower plates 126, 128, and which extend through the side walls 118, 120.

The cage member 102 has numerous features allowing the grounding of the cage member 102 to a motherboard and/or a further panel. The lower wall 116 and side walls 118, 120 include press fit pins 138 extending therefrom that are configured to be received in plated ground vias of the motherboard to electrically ground the cage member 102 to the ground plane of the motherboard. The press fit pins 138 are profiled to both mechanically hold the cage member 102 to the motherboard as well as to ground the cage member 102 thereto. The lower wall 116 may include similar press fit pins or other features to provide grounding of the cage member 102 to the motherboard. Around the perimeter of the cage member 102 towards the front edge thereof, the cage member 102 may include a plurality of resilient tabs profiled to engage an edge of an opening through which the cage member 102 is inserted, such as an opening in a panel or chassis.

The separator member 122 includes latches 144 adjacent a front edge thereof for securing the pluggable module 106 to the cage member 102. The latches 144 have latch openings 146 for latching engagement with the pluggable module 106. The latches 144 are deflectable and are stamped from the upper and lower plates 126, 128.

The lower wall 116 includes an opening 150 therethrough. The receptacle connector 104 is received in the opening 150. The receptacle connector 104 is accessible through the lower port 112 and the upper port 110. The separator member 122 does not extend to the rear wall 117, but rather stops short of the rear wall 117 to provide a space for the receptacle connector 104 to be loaded into the upper port 110.

Figure 2:
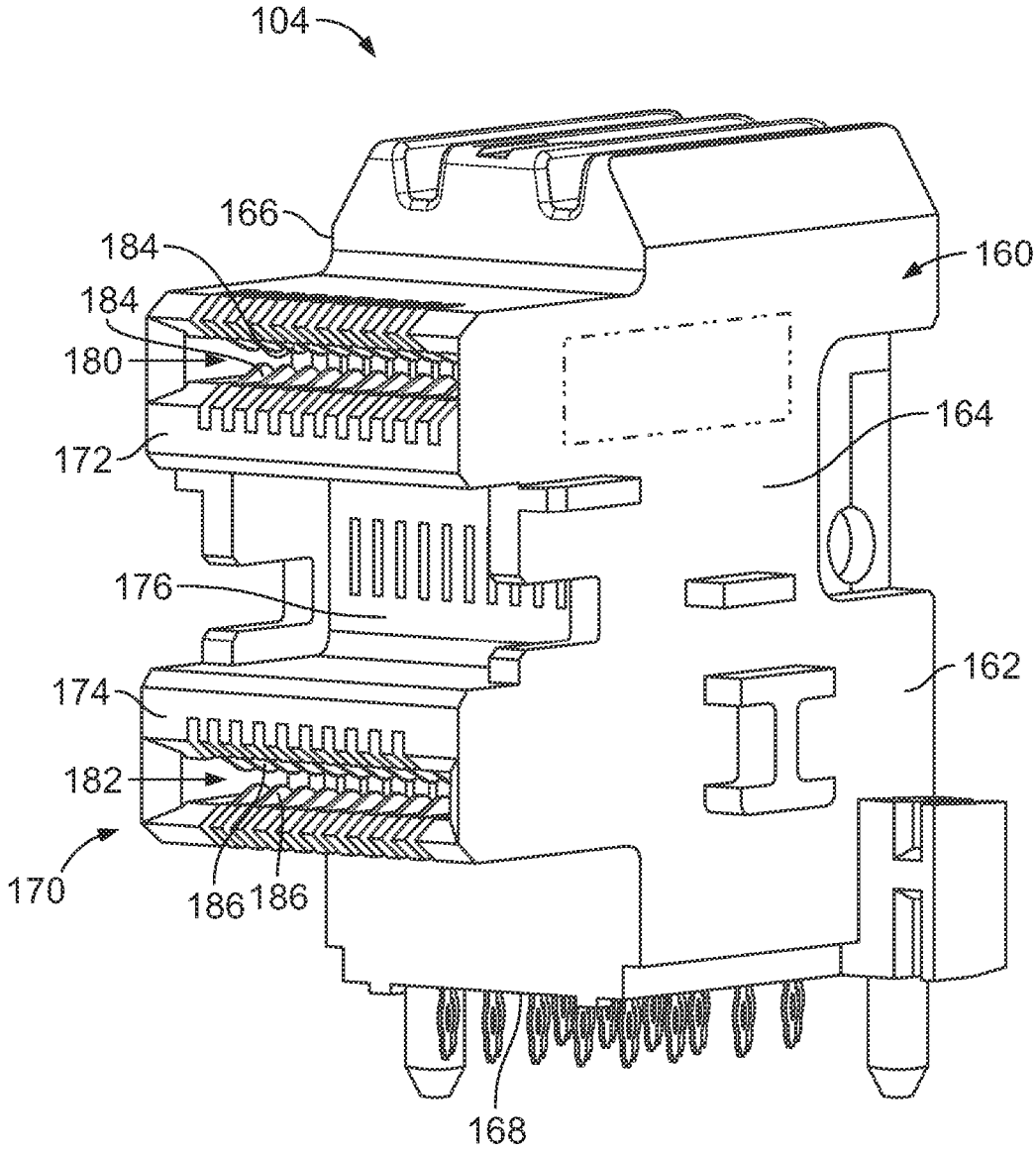
FIG. 2 is a front perspective view of one of the receptacle connectors shown in FIG. 1.

FIG. 2 is a front perspective view of the receptacle connector 104. The receptacle connector 104 includes a housing 160 defined by an upstanding body portion 162 having side walls 164, 166, a lower face 168 configured to be mounted to the motherboard, and a mating face 170. Upper and lower extension portions 172 and 174 extend from the body portion 162 to define the mating face 170. A recessed face 176 is defined between the upper and lower extensions 172, 174 at the front face of the body portion 162.

Circuit card receiving slots 180 and 182 extend inwardly from the mating face 170 of each of the respective upper and lower extensions 172, 174, and extend inwardly to the housing body 160. The circuit card receiving slots 180, 182 are configured to receive a card edge of the pluggable module 106 (shown in FIG. 7). A plurality of contacts 184 are held by the housing 160 and are exposed within the circuit card receiving slot 180 for mating with the corresponding pluggable module 106. The contacts 184 extend from the lower face 168 and are terminated to the motherboard. For example, the ends of the contacts 184 may constitute pins that are loaded into plated vias of the motherboard. Alternatively, the contacts 184 may be terminated to the motherboard in another manner, such as by surface mounting to the motherboard. A plurality of contacts 186 are held by the housing 160 and are exposed within the circuit card receiving slot 182 for mating with the corresponding pluggable module 106. The contacts 186 extend from the lower face 168 and are terminated to the motherboard.

Figure 3:
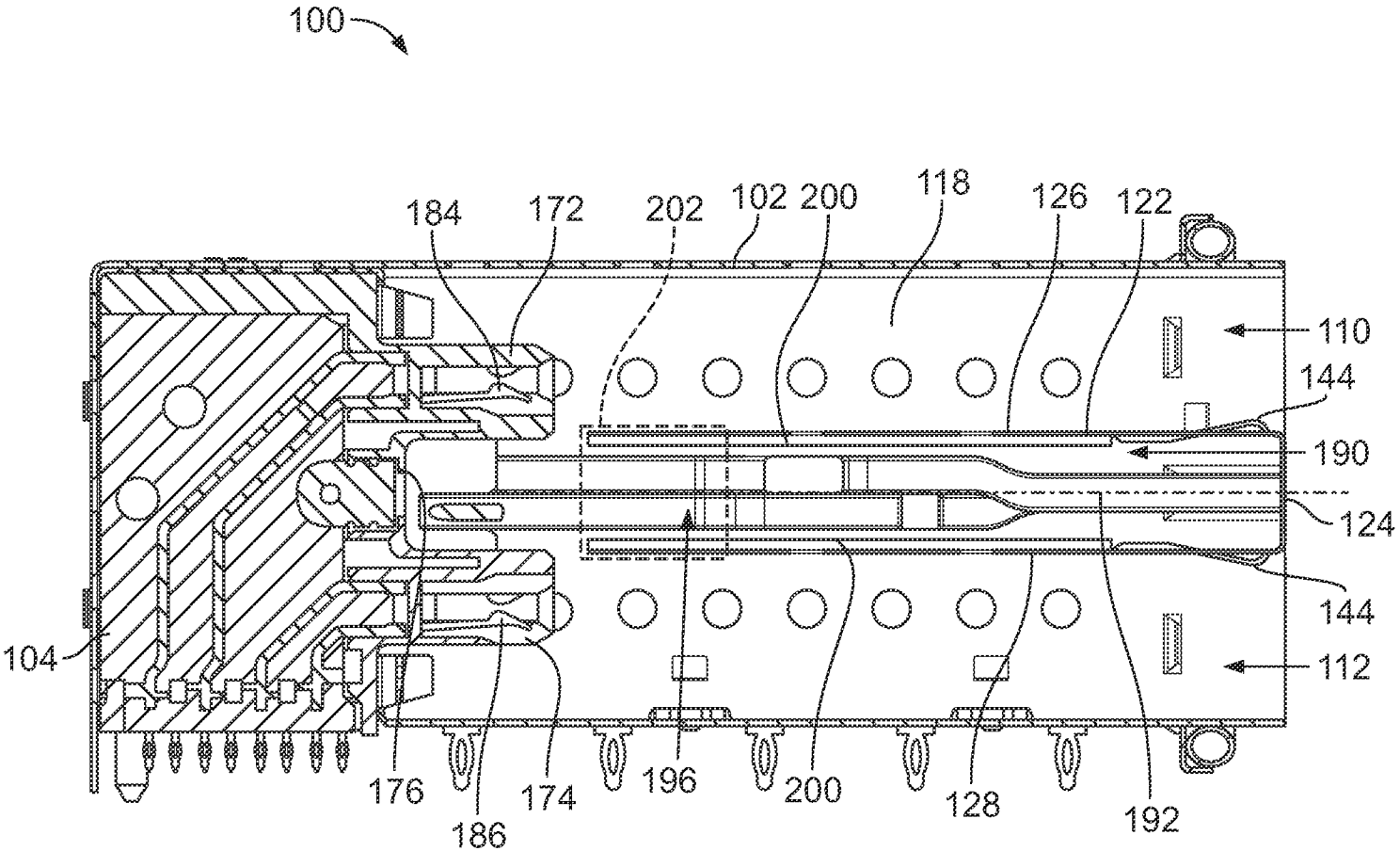
FIG. 3 is a side view of the electrical connector assembly.

FIG. 3 is a side view of the electrical connector assembly 100. The receptacle connector 104 is illustrated loaded into the cage member 102. The upper and lower extension portions 172 and 174 are aligned within the upper and lower ports 110, 112. The separator member 122 is aligned with the recessed face 176. The contacts 184, 186 function as an antenna and radiate energy when the contacts 184, 186 are excited with energy, such as during signal transmission. Such energy is radiated through the cage member 102, including through the separator member 122.

The separator member 122 includes a channel 190 defined between the upper and lower plates 126, 128. The channel 190 is elongated and extends along a longitudinal axis 192 generally from the receptacle connector 104 to the front wall 124. The channel 190 is open at the back end of the separator member 122. The channel 190 extends to the front wall 124. The latches 144 may be at least partially deflected into the channel 190 when the pluggable modules 106 (shown in FIG. 7) are loaded into the ports 110, 112. Portions of the pluggable modules 106 may be at least partially received in the channel 190 when the pluggable modules 106 are loaded into the ports 110, 112. The channel 190 defines a space that allows the latches 144 and/or portions of the pluggable modules 106 to extend into during use. The upper and lower plates 126, 128 are spaced apart to accommodate the latches 144 and/or portions of the pluggable modules 106.

In an exemplary embodiment, the electrical connector assembly 100 includes a light pipe (LP) structure 196 that includes one or more light pipes. The light pipe structure 196 is routed through the channel 190 to the front wall 124. The light pipe structure 190 transmits light that may originate from light emitting diodes (LEDs) on the motherboard mounted proximate to the receptacle connector 104. The light is transmitted by the light pipe structure 196 from the LEDs to a remote location that is viewable or detectable by an operator. The light indicates a condition of the electrical and/or optical connection between the pluggable module 106

(shown in FIG. 7) and the receptacle connector 104. The condition may relate to a quality of transmission between the pluggable module 106 (shown in FIG. 7) and the receptacle connector 104. For example, the status indication may be a colored light (e.g., green for high quality transmission, red for poor transmission or to indicate a disconnection). The status indication may be a light that flashes or blinks at a predetermined frequency.

The receptacle connector 104 generates electric fields which are propagated through the cage member 102. The electric fields are propagated in the general direction of the longitudinal axis 192 of the channel 190. The energy is propagated down the channel 190 along the longitudinal axis 192 toward the front wall 124. The contacts 184, 186 are one source of such electric fields, which are radiated outward and down the channel 190. The walls of the cage member 102, being metal, serve to stop most EMI leakage from the cage member 102. However, there are portions of the cage member 102 which are susceptible to EMI leakage. For example, EMI leakage may exist at the front wall 124, where the light pipe openings extend through the front wall 124 and/or at the openings around the latches 144 and/or at the seam between the separator member 122 and the cage member 102. The EMI propagates down the channel 190 along the longitudinal axis 192 and is leaked through such areas. In an exemplary embodiment, the electrical connector assembly 100 includes RF absorbers 200 positioned within the channel 190 to reduce or even eliminate EMI leakage from the channel 190.

The RF absorbers 200 are manufactured from an EMI absorbent material and reduce the amount of energy propagated through the cage member 102, particularly through the channel 190 and the walls defining the channel 190. The RF absorbers 200 reduce an amount of EMI emitted from the channel 190, such as through the front wall 124 and/or through the openings surrounding the latches 144 at the front edges of the upper and lower plates 126, 128. In an exemplary embodiment, the RF absorbers 200 eliminate substantially all EMI leakage from the channel 190. The RF absorbers 200 are manufactured from a material having a high relative permeability to absorb EMI and limit the total radiated power from the channel 190. The RE absorbers 200 effectively increase the impedance of the channel 190, reflecting some energy upon entry of the energy into the channel 190, and absorbing the energy that penetrates the channel 190. The RF absorbers 200 reduce energy reflections off of the conductive ground planes defined by the upper and lower plates 126, 128. The efficiency of the RE absorbers 200 may depend on the formulation and application (thickness, relative permeability, size, location, and the like) of the RF absorbers 200.

In an exemplary embodiment, the RF absorbers 200 comprise thin, magnetically loaded elastomeric sheets. The RF absorbers 200 may be manufactured from various materials, such as rubber, nitrile, silicon, viton, neoprene, hypolan, urethane, or other elastomeric materials. The RF absorbers 200 may have magnetic fillers included within the elastomeric material, such as a carbonyl iron powder, an iron silicide, or other magnetic fillers. The type of material within the RF absorbers 200 may be selected to target EMI at different frequencies. In an exemplary embodiment, the RF absorber 200 may be a Q-Zorb™ material, commercially available from Laird Technologies.

The thickness of the RE absorbers 200 may be selected to control the amount of EMI reduction. For example, different thicknesses of the RF absorbers 200 may be used to target energy at different frequencies. In an exemplary embodiment, the RF absorbers 200 are relatively thin, such that the RF absorbers 200 do not fill too much of the space of the channel 190, such as to maintain a space for the light pipe structure 196 and/or an airflow path through the channel 190. In the illustrated embodiment, the RF absorbers 200 are approximately 1.0 mm thick. Other thicknesses are possible in alternative embodiments. In an exemplary embodiment, the RE absorber 200 takes up less than half a total volume of the channel 190. Optionally, the RF absorber may take up less than 10% of the volume of the channel 190. Alternatively, where air flow is not a consideration, the RF absorber 200 may take up the entire volume of the channel 190.

The positioning of the RF absorbers 200 within the channel 190 may be selected to control the amount of EMI reduction. In an exemplary embodiment, the RF absorbers 200 are positioned in close proximity to the receptacle connector 104, which is the source of the electric fields. For example, the RF absorbers 200 are positioned at the rear end of the separator member 122. In the illustrated embodiment, the RF absorbers 200 are positioned along the interior faces of the upper and lower plates 126, 128 (e.g. the surfaces that face the channel 190). The RF absorbers 200 extend generally parallel to the longitudinal axis 192 and the direction of electric field propagation from the receptacle connector 104. The RF absorbers 200 thus extend generally parallel to the direction of propagation of the energy through the channel 190. The RF absorbers 200 thus constitute surface wave absorbers, which are oriented parallel to the direction of EMI propagation.

Optionally, the RF absorbers 200 may have adhesive backings that allow the RF absorbers 200 to be applied to the interior surfaces of the upper and lower plates 126, 128. Alternative securing means may be used in alternative embodiments to secure the RF absorbers 200 to the upper and lower plates 126, 128. The RF absorbers 200 may be positioned in different locations in alternative embodiments. For example, the RF absorbers 200 may be positioned along the interior faces of the side walls 118, 120 (shown in FIG. 1) within the channel 190. The RF absorbers 200 may be positioned at the front wall 124 and/or covering the openings surrounding the latches 144.

In an alternative embodiment, rather than a thin sheet, the RF absorber 200 may be thicker and may be positioned within the channel 190 to substantially or entirely fill an area of the channel 190, such as the area identified as area 202, thus functioning as a plug. The area 202 may be positioned at a different location along the channel 190 in alternative embodiments. The area 202 may be longer or shorter in alternative embodiments, filling a larger or smaller volume of the channel 190. In such cases where the RF absorber 200 is used as a plug, the light pipe structure 196 would not be used or would be rerouted within the cage member 102 to allow the RF absorber 200 to be positioned in such area 202. Alternatively, the RF absorber 200 may be molded around the light pipe structure 196 and fill the area of the channel 190, but still allow the light pipe structure 196 to pass therethrough.

Figure 4:
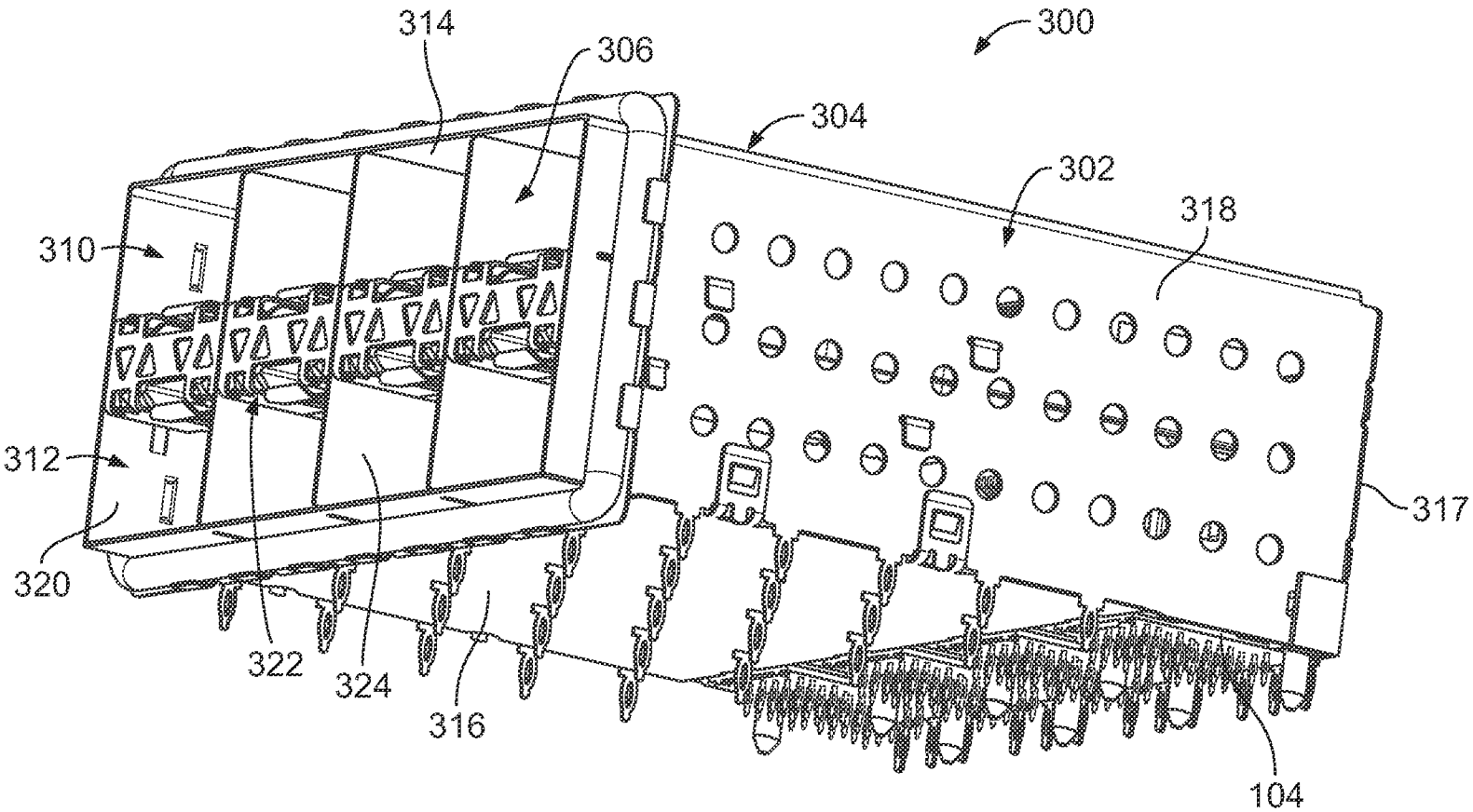
FIG. 4 is a front perspective view from an underside of an alternative electrical connector assembly showing a cage member and a plurality of receptacle connectors.

FIG. 4 is a front perspective view from an underside of an alternative electrical connector assembly 300 showing a cage member 302 and a plurality of the receptacle connectors 104. Pluggable modules 106 (shown in FIG. 7) are configured to be loaded into the cage member 302 for mating with the receptacle connector 104.

The cage member 302 is a shielded, stamped and formed cage member that includes a plurality of exterior shielded walls 304 and a plurality of interior shielded walls 306 defining the cage member 302. The cage member 302 differs from the cage member 102 (shown in FIG. 1) in that the cage member 302 includes more ports. The cage member 302 includes a plurality of upper ports 310 and a plurality of lower ports 312. While four columns of ports 310, 312 are shown, it is realized that any number of columns of ports may be provided in alternative embodiments.

The exterior shielded walls 304 includes a top wall 314, a lower wall 316, a rear wall 317 and side walls 318, 320, which together define the general enclosure for the cage member 302. The interior shielded walls 306 include separator members 322 between the rows of ports 310, 312 and divider walls 324 between the columns of ports 310, 312. The separator members 322 extend between one of the side walls 318, 320 and one of the divider walls 324 or between adjacent ones of the divider walls 324.

Figure 5:
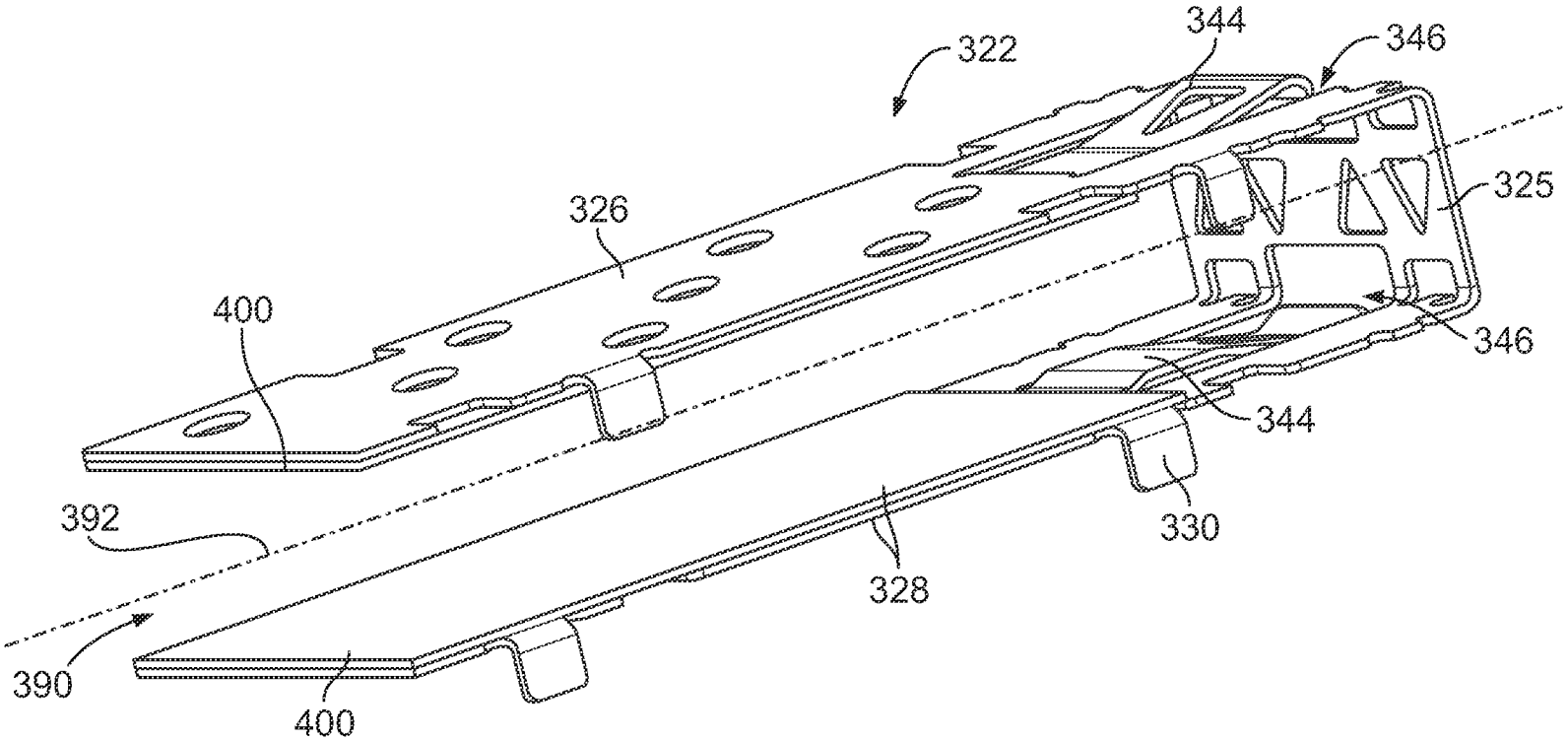
FIG. 5 is a perspective view of a separator member for the cage member shown in FIG. 1 and/or FIG. 4.

FIG. 5 is a perspective view of one of the separator members 322, which may be identical to the separator member 122 (shown in FIG. 1). The separator member 322 is stamped and formed from a metal piece into a U-shaped structure. The separator member 322 has a front wall 325 with an upper plate 326 and a lower plate 328 extending rearward from the front wall 325. The separator member 322 includes tabs 330 extending therefrom that engage the corresponding side walls 318, 320 or divider walls 324 (shown in FIG. 4).

The separator member 322 includes latches 344 adjacent a front edge thereof for securing the pluggable module 106 (shown in FIG. 7) to the cage member 302. The latches 344 have latch openings 346 for latching engagement with the pluggable module 106. The latches 344 are deflectable and are stamped from the upper and lower plates 326, 328.

The separator member 322 includes a channel 390 defined between the upper and lower plates 326, 328. The channel 390 is elongated and extends along a longitudinal axis 392 between the open rear end and the front wall 325. The latches 344 may be at least partially deflected into the channel when the pluggable modules 106 are loaded into the ports 310, 312 (shown in FIG. 4). Portions of the pluggable modules 106 may be at least partially received in the channel 390 when the pluggable modules 106 are loaded into the ports 310, 312. The channel 390 defines a space that allows the latches 344 and/or portions of the pluggable modules 106 to extend into during use. The upper and lower plates 326, 328 are spaced apart to accommodate the latches 344 and/or portions of the pluggable modules 106.

In an exemplary embodiment, the electrical connector assembly 300 includes RF absorbers 400 positioned within the channel 390 to reduce or even substantially eliminate EMI leakage from the channel 390. The RF absorbers 400 are positioned at the rear end of the separator member 322. In the illustrated embodiment, the RF absorbers 400 are positioned along the interior faces of the upper and lower plates 326, 328 (e.g. the surfaces that face the channel 390). The RF absorbers 400 extend generally parallel to the longitudinal axis 392.

Optionally, the RF absorbers 400 may have adhesive backings that allow the RF absorbers 400 to be applied to the interior surfaces of the upper and lower plates 326, 328. Alternative securing means may be used in alternative embodiments to secure the RF absorbers 400 to the upper and lower plates 326, 328. The RF absorbers 400 may be positioned in different locations in alternative embodiments.

Figure 6:
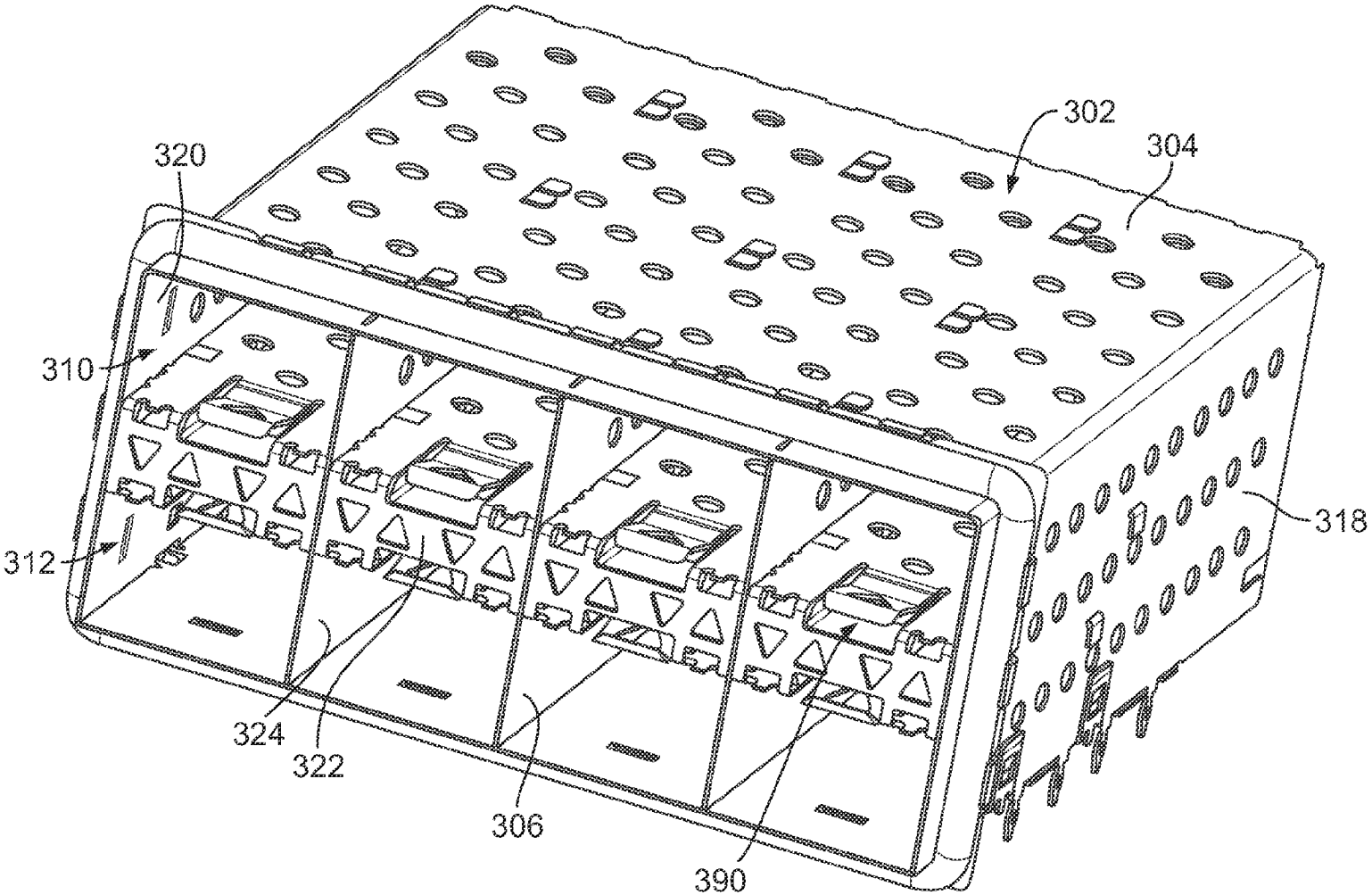
FIG. 6 is a front perspective view of the cage member shown in FIG. 4 less the receptacle connectors.

FIG. 6 is a front perspective view of the cage member 302 less the receptacle connectors 104 (shown in FIG. 4). The separator members 322 are connected to the corresponding walls 318, 320, 324. The separator members 322 are electrically connected to the other walls 304, 306 to provide shielding between the upper and lower ports 310, 312. Light pipe structures 196 (shown in FIG. 3) may be held within the channels 390. The RF absorbers 400 reduce EMI leakage from the separator members 322 by absorbing energy propagated down the channel 390.

Figure 7:
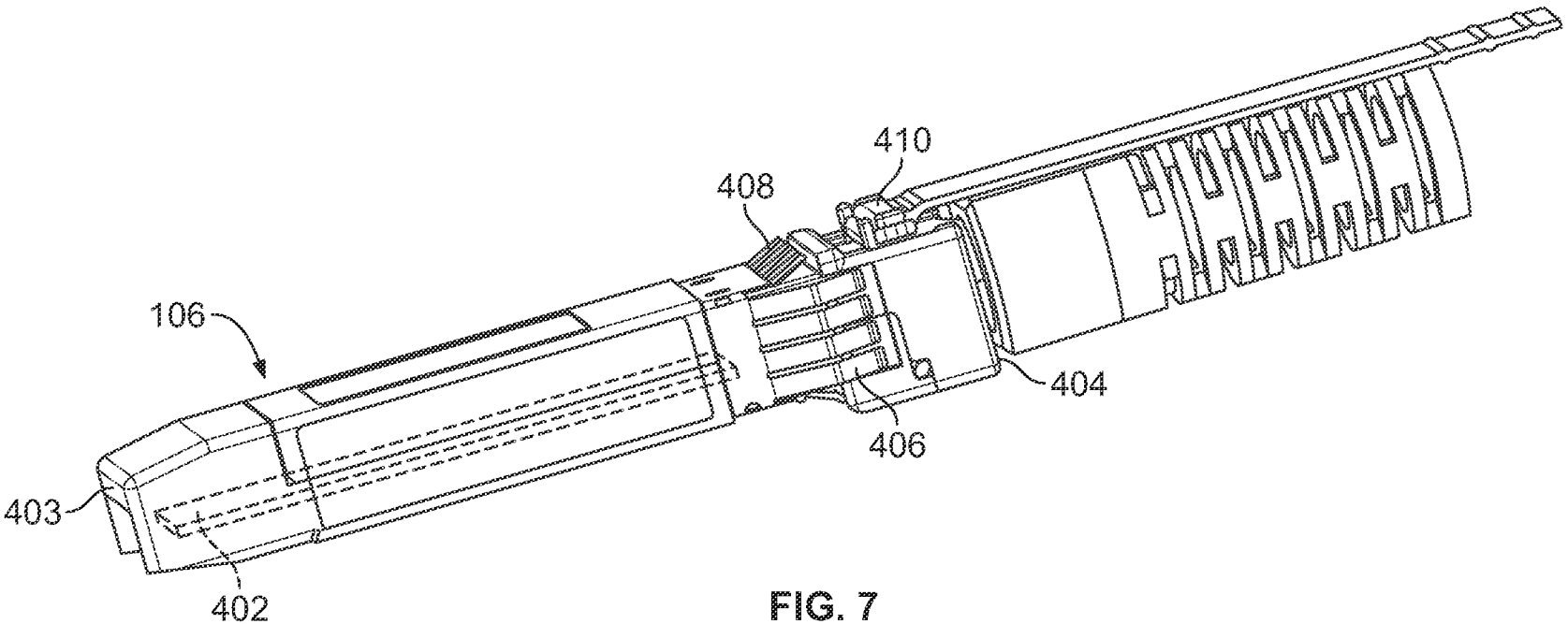
FIG. 7 is a perspective view of a pluggable module for receipt within the cage members and for interconnection with the receptacle connectors.

FIG. 7 illustrates a pluggable module 106 for use with the electrical connector assemblies 100, 300 (shown in FIGS. 1 and 4). In the illustrated embodiment, the pluggable module 106 constitutes a small form-factor pluggable (SFP) module having a circuit card 402 at a mating end 403 thereof for interconnection into the slots 180, 182 (shown in FIG. 2) and into interconnection with the contacts 184 or 186 therein. The pluggable module 106 would further include an electrical interconnection within the module to an interface at end 404, such as a copper interface in the way of a modular jack, or to a fiber optic connector for further interfacing. The pluggable module 106 would also include grounding tabs 406, 408, and a raised embossment 410. The embossment 410 would latch into the triangular shaped opening of the latch 144 (shown in FIG. 1) or latch 344 (shown in FIG. 5). This allows for easy extraction of the pluggable module 106 as the latches 144, 344 are accessible from the front end of the corresponding cage member 102 or 302 (shown in FIG. 4). Other types of pluggable modules or transceivers may be utilized in alternative embodiments.

Figure 8:
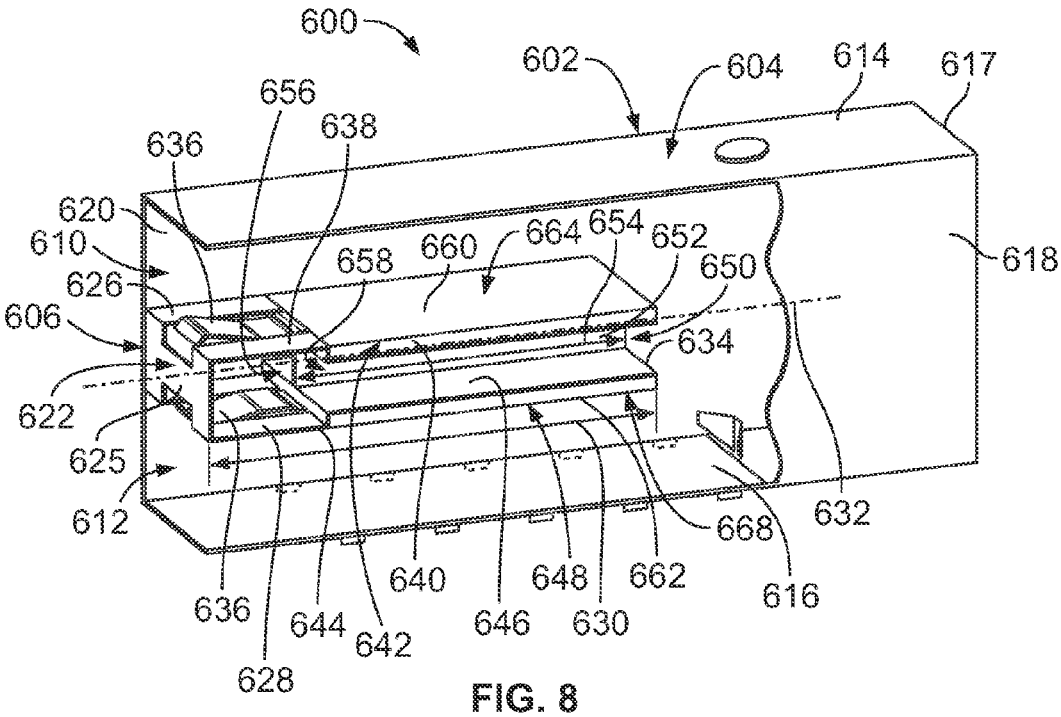
FIG. 8 is a partial sectional view of an electrical connector assembly formed in accordance with an exemplary embodiment.

FIG. 8 is a partial sectional view of an electrical connector assembly 600 showing a cage member 602, with a wall removed to show internal components thereof. The electrical connector assembly 600 is illustrated as being a 1X2 version similar to the embodiment of FIG. 1, however other versions may be used in alternative embodiments. The cage member 602 may receive one or more of the receptacle connectors 104 (shown in FIG. 2). Pluggable modules 106 (shown in FIG. 7) are configured to be loaded into the cage member 602 for mating with the receptacle connector 104.

The cage member 602 is a shielded, stamped and formed cage member that includes shielded walls 604. The cage member 602 includes an upper port 610 and a lower port 612, however any number of upper and lower ports may be provided in alternative embodiments. The shielded walls 604 include a top wall 614, a lower wall 616, a rear wall 617 and side walls 618, 620, which together define the general enclosure for the cage member 602.

The cage member 602 includes interior shielded walls 606, including a separator member 622 between the upper and lower ports 610, 612. The separator member 622 is stamped and formed from a metal piece into a U-shaped structure. The separator member 622 has a front wall 625 with an upper plate 626 and a lower plate 628 extending rearward from the front wall 625. The separator member 622 extends a length 630 along a longitudinal axis 632 between the front wall 625 and a rear end 634 of the separator member 622. The separator member 622 includes latches 636 adjacent the front wall 625 for securing the pluggable module 106 (shown in FIG. 7) to the cage member 602.

The upper plate 626 includes an exterior surface 638 facing the upper port 610 and an interior surface 640 opposite the exterior surface 638. The upper plate 626 includes an upper pocket 642 that is upward facing. The upper pocket 642 is defined by the exterior surface 638. The upper pocket 642 is recessed below other portions of the upper plate 626. Similarly, the lower plate 628 includes an exterior surface 644 facing the lower port 612 and an interior surface 646 opposite the exterior surface 644. The lower plate 628 includes a lower pocket 648 that is downward facing. The lower pocket 648 is defined by the exterior surface 644. The lower pocket 648 is elevated above other portions of the lower plate 628.

The separator member 622 includes a channel 650 defined between the upper and lower plates 626, 628. The interior surfaces 640, 646 face the channel 650. The channel 650 is elongated and extends along the longitudinal axis 632 between the open rear end 634 and the front wall 625. The front wall 625 may include openings for light pipes or airflow. The upper and lower plates 626, 628 are spaced apart to accommodate the latches 644, portions of the pluggable modules 106 and/or light pipes.

In an exemplary embodiment, the separator member 622 includes a divider wall 652 in the channel 650. The divider wall 652 extends between the interior surfaces 640, 646 of the upper and lower plates 626, 628. The divider wall 652 may be approximately centrally positioned between the side walls 618, 620. The divider wall 652 is electrically connected to the upper plate 626 and the lower plate 628. The divider wall 652 makes ohmic contact to the upper plate 626 and the lower plate 628 at multiple locations along the length of the separator member 622. Optionally, the divider wall 652 may be separately provided from, and mechanically connected to, the upper plate 626 and the lower plate 628. Alternatively, the divider wall 652 may be integrally formed with the upper plate 626 and/or the lower plate 628. In other alternative embodiments, more than one divider wall may be provided.

The divider wall 652 extends a length 654. In an exemplary embodiment, the length 654 is at least half the length 630 of the separator member 622. The divider wall 652 divides the channel 650 into a first sub-channel 656 between the divider wall 652 and the side wall 620, and a second sub-channel 658 between the divider wall 652 and the other side wall 618. Optionally, the divider wall 652 may include airflow openings (not shown) therethrough to allow airflow from one side of the divider wall 652 to the other side of the divider wall 652. The divider wall 652 may reduce EMI propagation by increasing (e.g. doubling) the cutoff frequency of the channel 650 created by the separator member 622.

In an exemplary embodiment, the electrical connector assembly 600 includes RF absorbers 660, 662 that reduce or even substantially eliminate EMI propagation along the upper and lower ports 610, 612. The RF absorbers 660, 662 extend generally parallel to the longitudinal axis 632. The RF absorbers 660, 662 are applied directly to the upper and lower plates 626, 628, respectively. The RF absorbers 660, 662 suppress surface current along the upper and lower plates 626, 628 to reduce and/or cancel electric field propagation along the upper and lower plates 626, 628. Optionally, the RF absorbers 660, 662 may extend at least half of the length 630 of the separator member 622. The RF absorbers 660, 662 are relatively thin to maintain sufficient spacing between the upper and lower plates 626, 628 within the channel 650 for airflow, lightpipes or other components.

In an exemplary embodiment, the RF absorbers 660, 662 are received in the upper and lower pockets 642, 648, respectively. The RF absorber 660 is positioned in the upper pocket 642 such that an outer surface 664 of the RF absorber 660 faces the upper port 610 and is substantially coplanar with a portion of the upper plate 626, such as the portion having the latch 636. The pluggable module 106 loaded into the upper port 610 may be in close proximity to, or may engage, the RF absorber 660. The RF absorber 662 is positioned in the lower pocket 648 such that an outer surface 668 of the RF absorber 662 faces the lower port 612 and is substantially coplanar with a portion of the lower plate 628, such as the portion having the latch 636. The pluggable module 106 loaded into the lower port 612 may be in close proximity to, or may engage, the RF absorber 662. In alternative embodiments, rather than being received in pockets, the upper and lower plates 626, 628 may be planar with the RF absorbers 660, 662 applied directly to the exterior surfaces thereof.

Providing the RF absorbers 660, 662 on the exterior surfaces 638, 644 of both the upper and lower plates 626, 628 reduces and/or eliminates EMI propagation along the upper and lower ports 610, 612.

Figure 9:
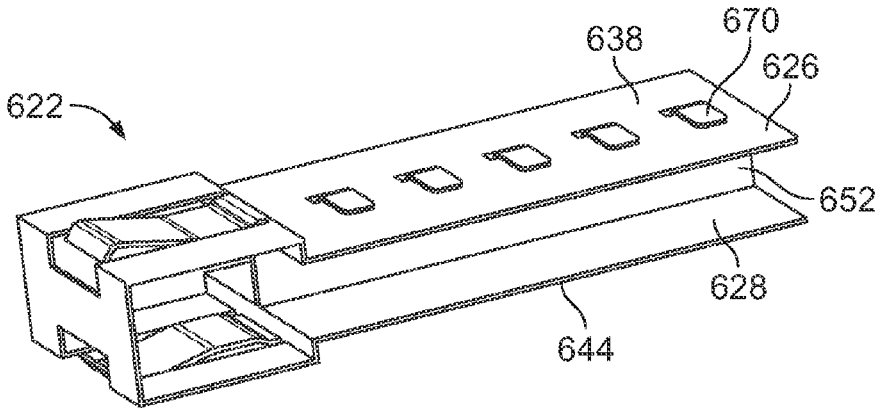
FIG. 9 illustrates a separator member for the electrical connector assembly.

FIG. 9 illustrates the separator member 622 without the RF absorbers 660, 662 (both shown in FIG. 8). In the illustrated embodiment, the divider wall 652 includes tabs 670 that extend through the upper and lower plates 626, 628. The tabs 670 are bent over to secure the divider wall 652 to the upper and lower plates 626, 628. The tabs 670 make direct mechanical and electrical connection to the separator member 622. The tabs 670 engage the exterior surfaces 638, 644 of the upper and lower plates 626, 628.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a shielding cage member having an upper port and a lower port configured to receive pluggable modules therein, the cage member having side walls along the sides of the upper and lower ports;

a separator member extending between the side walls and disposed between the upper and lower ports, the separator member having an upper plate and a lower plate with a channel therebetween, the upper and lower plates having interior surfaces facing the channel, the upper and lower plates having exterior surfaces facing the upper and lower ports, respectively;

RF absorbers positioned along the exterior surfaces and exposed along the upper and lower ports, the RF absorbers reducing an amount of EMI propagation through the cage member; and a divider wall positioned in the channel and extending between the interior surfaces of the upper and lower plates.

2. The electrical connector assembly of claim 1, wherein the divider wall is approximately centrally positioned between the side walls.

3. The electrical connector assembly of claim 1, wherein the divider wall makes ohmic contact to the upper plate and the lower plate.

4. The electrical connector assembly of claim 1, wherein the upper and lower plates extend lengthwise along a longitudinal axis, the divider wall extending a length at least half a length of the separator member.

5. The electrical connector assembly of claim 1, wherein the upper plate includes an upper pocket receiving the corresponding RF absorber such that an outer surface of such RF absorber facing the upper port is substantially coplanar with a portion of the upper plate, the lower plate includes a lower pocket receiving the corresponding RF absorber such that an outer surface of such RF absorber facing the lower port is substantially coplanar with a portion of the lower plate.

6. The electrical connector assembly of claim 1, wherein the divider wall divides the channel into a first sub-channel between the divider wall and one of the side walls and the divider wall divides the channel into a second sub-channel between the divider wall and the other of the side walls.

7. The electrical connector assembly of claim 1, wherein the divider wall includes airflow openings therethrough to allow airflow from one side of the divider wall to another side of the divider wall.

8. The electrical connector assembly of claim 1, further comprising a first light pipe extending through the channel along a first side of the divider wall and a second light pipe extending through the channel along a second side of the divider wall.

9. The electrical connector assembly of claim 1, wherein the RF absorbers comprise sheets applied to the exterior surfaces of the upper and lower plates.

10. The electrical connector assembly of claim 1, wherein the RF absorbers constitute surface wave absorbers arranged generally parallel to a direction of EMI propagation through the cage member.

11. The electrical connector assembly of claim 1, wherein the RF absorbers are fabricated from elastomeric material.

12. The electrical connector assembly of claim 1, further comprising a receptacle connector received in the cage member, the receptacle connector being accessible through the upper port and the lower port, the pluggable modules being electrically connected to the receptacle connector.

13. The electrical connector assembly of claim 1, wherein the separator member is U-shaped with a front wall between the upper plate and the lower plate, the electrical connector assembly further comprising a receptacle connector received in the cage member rearward of the separator member, the receptacle connector generating an energy field through the channel and the upper and lower ports in the direction of the front wall, the RF absorbers reducing the energy field propagation through the upper and lower ports, the divider wall reducing the energy field propagation through the channel.

* * * * *